US005511687A

United States Patent [19]

Garrett, Jr. et al.

[11] Patent Number: 5,511,687

[45] Date of Patent: Apr. 30, 1996

[54] WASTE COLLECTION AND SEPARATION SYSTEM

[76] Inventors: Billy J. Garrett, Jr.; William L. Aldridge; Harry R. Elliott, all of P.O. Drawer 3208, Greenwood, S.C. 29648

[21] Appl. No.: 187,602

[22] Filed: Mar. 24, 1994

[51] Int. Cl.[6] ..... B65F 3/12

[52] U.S. Cl. ..... 414/407; 220/507; 220/553; 220/909; 414/409

[58] Field of Search ..... 220/909, 507, 220/553, 404, 407; 414/409, 406, 407, 411

[56] References Cited

U.S. PATENT DOCUMENTS

| | | | |
|---|---|---|---|
| 581,322 | 4/1897 | Winters | 220/909 |
| 4,113,125 | 9/1978 | Schiller | 220/909 |
| 4,114,776 | 9/1978 | Pluss | 220/909 |
| 4,960,220 | 10/1990 | Foa | 220/909 |
| 5,015,142 | 5/1991 | Carson | 220/909 |
| 5,015,143 | 5/1991 | Carson | 220/909 |
| 5,035,563 | 7/1991 | Mezey | 220/909 |
| 5,094,582 | 3/1992 | Molzhon | 220/909 |
| 5,116,184 | 5/1992 | Pellegrini | 220/909 |
| 5,244,218 | 9/1993 | Irwin, Sr. | 220/909 |
| 5,275,522 | 1/1994 | Garrett, Jr. et al. | 414/409 |
| 5,303,841 | 4/1994 | Mezey | 220/909 |

*Primary Examiner*—David Scherbel
*Assistant Examiner*—Reginald L. Alexander
*Attorney, Agent, or Firm*—Michael A. Mann

[57] ABSTRACT

A system for separating waste by type and collecting the separated wastes, preserving the integrity of the separation during the collection and consolidation, comprising a multi-compartment inside container for the initial separation, an outside container that interfaces with the inside container so that the separated contents of the latter can be dumped into the former, a mobile collection unit that transfers the separated wastes from the outside container to a plurality of bins, again preserving the separation, and transports the waste to a distribution facility. The volume of the separated waste is reduced by the collection vehicle as it is dumped through hatches on the top of the vehicle into chutes that lead to the appropriate bin for that type of waste. The collection vehicle grips, lifts and inverts the outside container, made up of three subcontainers, and then separates them so that each can be positioned over and aligned with a different hatch on the top of the vehicle.

17 Claims, 9 Drawing Sheets

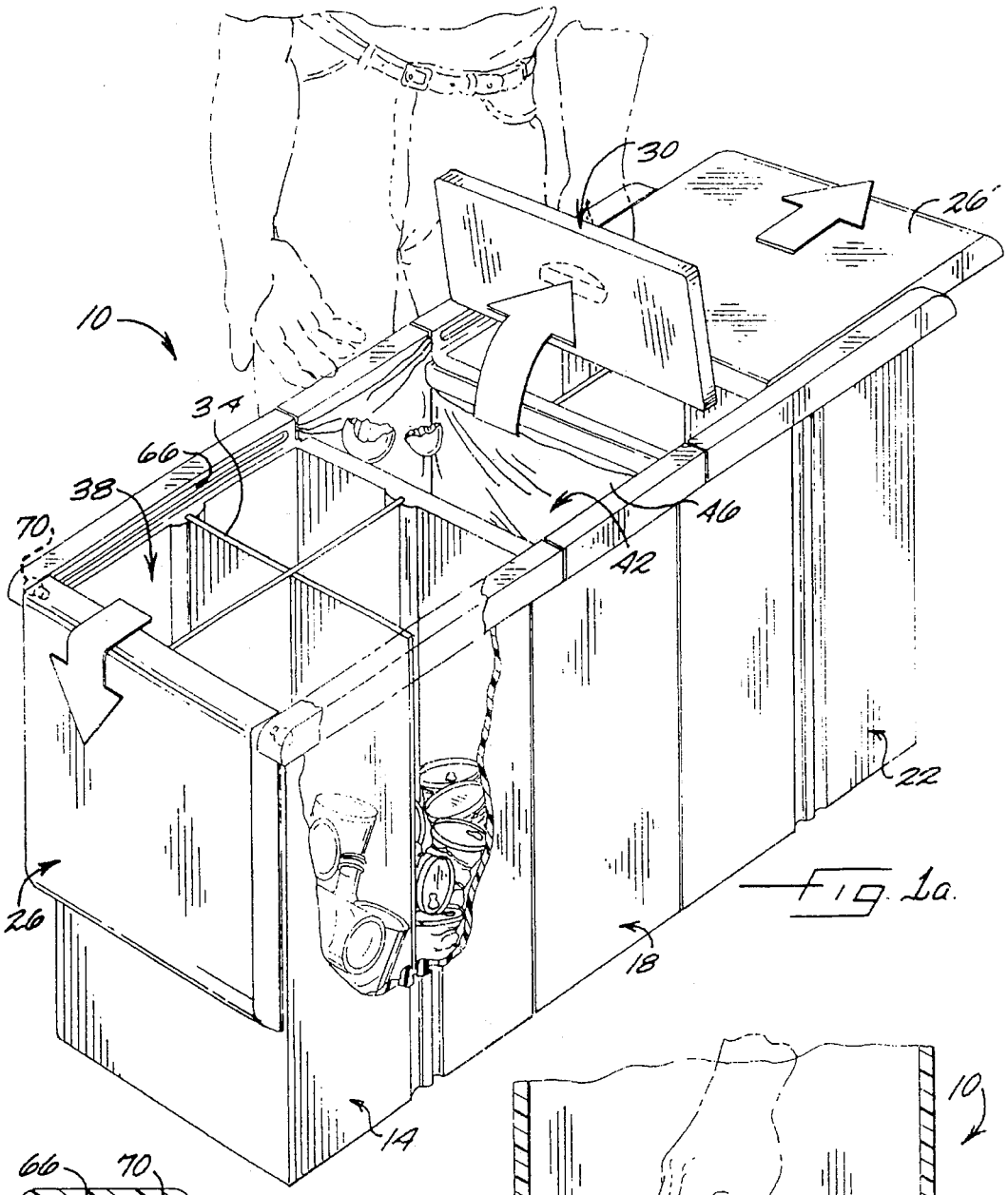
Fig. 1a.
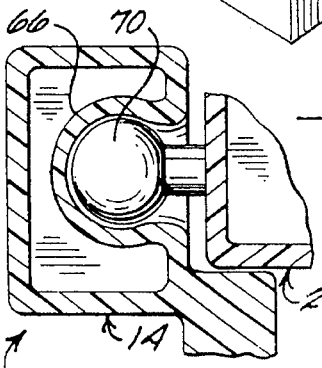
Fig. 1b.
Fig. 1c.
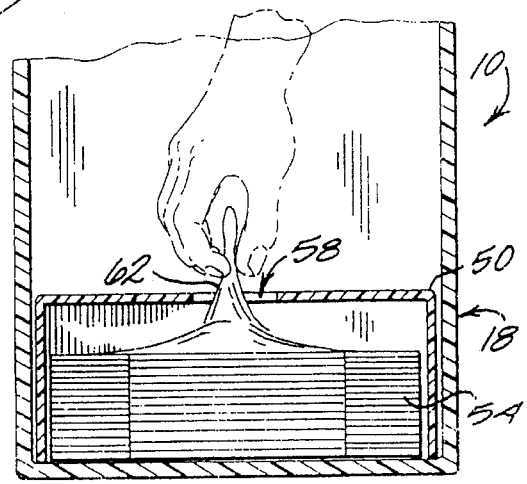

Fig 6a
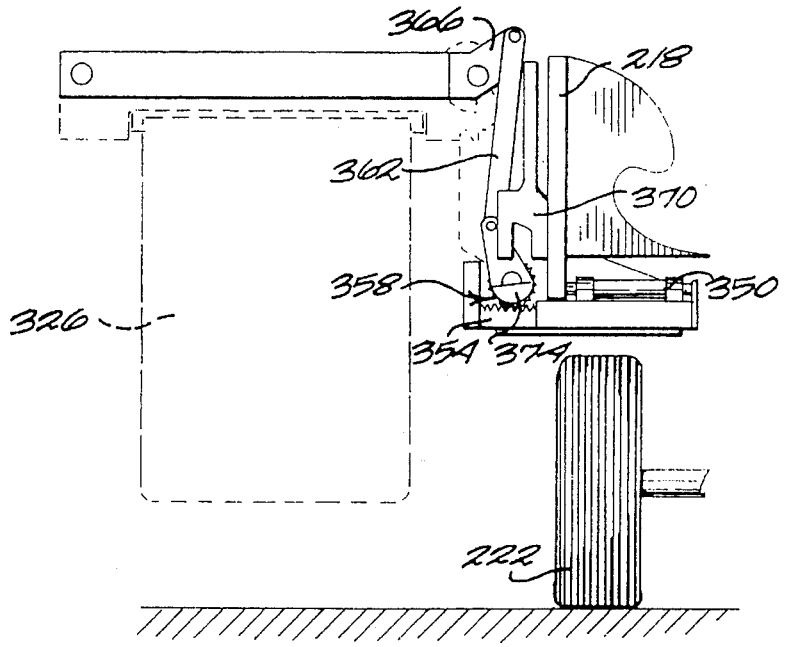
Fig 6b
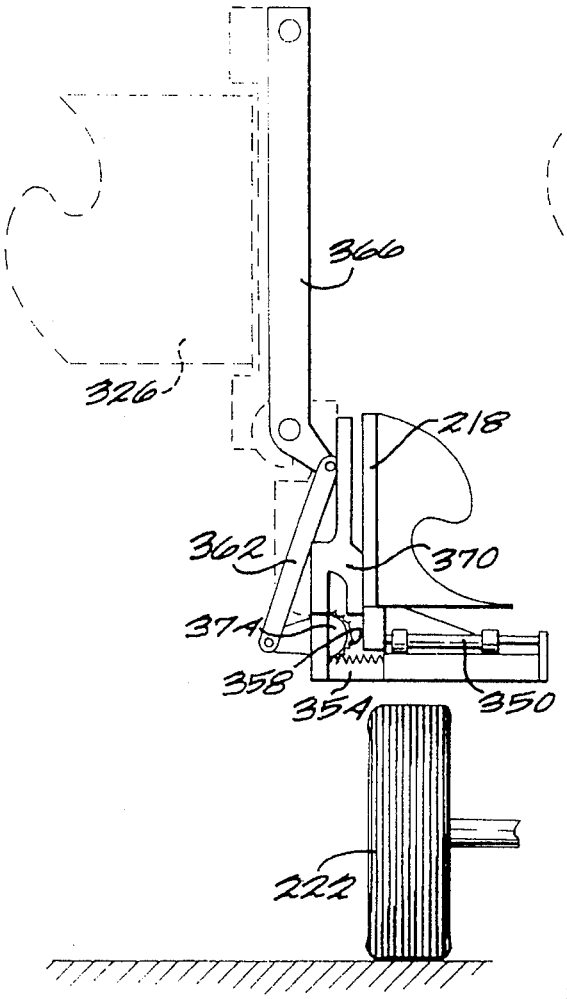
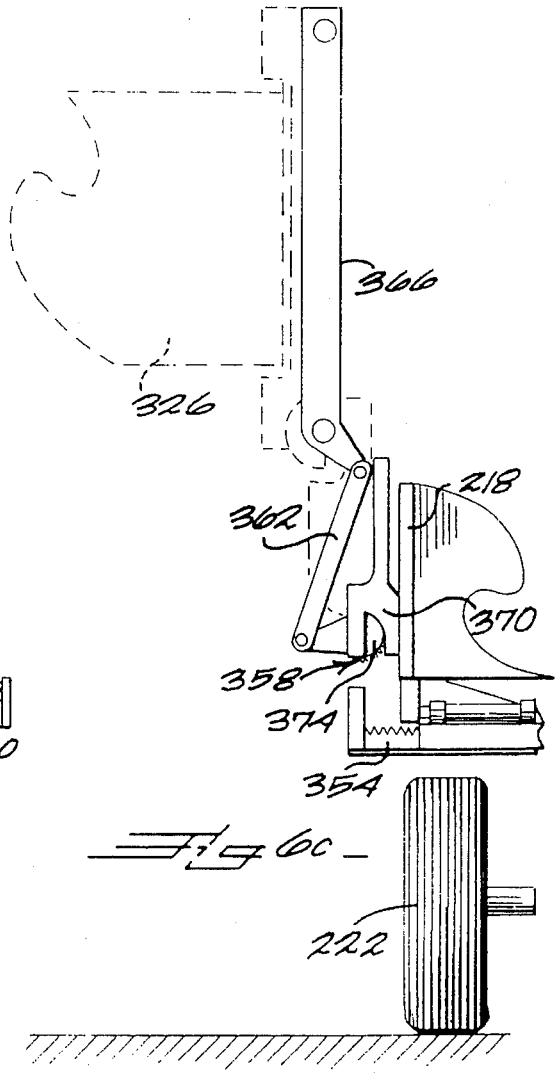
Fig 6c

WASTE COLLECTION AND SEPARATION SYSTEM

BACKGROUND OF THE INVENTION

1. Field of the Invention

The present invention relates to recycling household wastes. More particularly, the present invention relates to a system for efficiently collecting wastes that have been separated by type in a manner that preserves the integrity of the original separation.

2. Discussion of Background

Despite the growing concern about the environmental impact of industrial processes and waste generation, the amount of waste generated continues to be a problem in our society. It has been estimated that approximately 3.5 to 6.5 pounds of solid waste are generated per day for every individual in the United States. Additionally, the capacity of our landfills is steadily dwindling and the buried waste sometimes threatens to become a source of pollution.

One method for tackling this solid waste problem is recycling as much of household solid waste as possible. Recycled waste saves landfill space and provides resources for making new products.

Recycling involves the recovery of materials such as glass, plastic, metals and paper products for eventual reuse, thus reducing the overall amount of solid waste generated. By reusing much of the waste materials that are generated, recycling helps to extend the finite supply of raw materials.

Recycling has been taking place for many years, as have waste disposal and retrieval systems facilitating the collection and processing of recyclable waste. Also, multi-compartment containers for segregating household wastes are known. Likewise, vehicles designed to receive waste contained in these compartmentalized containers while maintaining separation of the segregated wastes collected are known.

For example, Pluss, in U.S. Pat. No. 4,114,776, discloses a container having separate compartments for recyclable materials. The container has a series of compartment partitions for forming compartments of different sizes. Also, Schiller, in U.S. Pat. No. 4,113,125, discloses a system for collecting and transporting a plurality of waste types using a vehicle having multiple collection chambers and a plurality of collection containers.

In U.S. Pat. Nos. 5,015,142 and 5,015,143, Carson discloses a waste collection system using a transportable, outdoor container that has a plurality of bins for dumping materials from a divided container into the separated bins. The plurality of bins have hinged doors opened by actuating a push plate catch release.

Similarly, Foa, in U.S. Pat. No. 4,960,220, discloses container assemblies for use with each other to transfer plural types of waste from one container to the other while maintaining separation of plural waste types. In this waste collection system, indoor containers are rotated about a fitting mounted on the outdoor containers to invert the indoor containers for conveying the contents of indoor container into corresponding outdoor container compartments. Also disclosed by Foa is an additional embodiment that uses lid openings rotating about a vertical axis to create sequentially a window for each compartment.

Nothing in these references uses the convenience of sliding compartment or container lids instead of liftable, rotatable covers. Also, current collection and transferal devices either feature single containers having multiple compartments or multiple containers housing separate types of wastes.

Nothing currently in use teaches a collection vehicle that can lift and invert a group of containers, each of which has multiple compartments for separated wastes, and can dump the separated wastes into the vehicle while preserving the integrity of the waste separation.

There exists a need for an improved waste collection system that maintains the integrity of the separation of wastes from initial collection of household wastes to distribution of the waste types.

SUMMARY OF THE INVENTION

According to its major aspects and broadly stated, the present invention is a system for separating wastes by type and collecting wastes in such a way that the separation is preserved as the waste is transferred from one container to another container. In particular, the present invention comprises an "inside" container, and "outside" container, a collection vehicle, and a distribution facility.

The inside container is for use in a home or office and has features that make it convenient for separating waste by type and for transfer of its contents in their separated condition to the larger, outside container. The outside container, in turn, interfaces with the collection vehicle so that its contents can be dumped into that vehicle so that the separation of the waste by type continues to be preserved. The mobile unit collects the separated contents of the various compartments of the outside container in large bins inside the unit and reduces the volume of the waste in the process. The bins on the mobile unit can be unloaded easily at the distribution facility so that the separated, volume-reduced waste can be hauled to various manufacturing plants for incorporation of the recycled waste into new products.

The inside container has a plurality of compartments, preferably nine for three types of glass (clear, green, brown), aluminum and other metal, paper, cardboard, plastic and trash/garbage. It has a lid that slides between an open and a closed position so that the inside container can be inverted over the outside container, aligned, and then the lid slid to the open position to allow the waste to fall into the corresponding compartments of the outside container. As long as the two containers are aligned, the separation of the waste performed by the user of the inside container is preserved.

The outside container is actually three separable "subcontainers." These are moved about preferably by a single cart. When the waste in the outside container is to be collected, the cart is moved next to the mobile collection unit. An apparatus mounted to the side or rear of the collection unit aligns the three subcontainers with each other, lifts the subcontainers to the top of the mobile collection unit and inverts them with respect to their initial positions. In one embodiment, the lifting apparatus lifts the subcontainers to the top of the mobile collection unit, where they are covered, removed from the lifting apparatus and rotated 180 degrees with respect to their initial positions. In another embodiment, the lifting apparatus covers and grips the subcontainers, rotates them approximately 90 degrees, and lifts them to the top of the collection vehicle housing, rotating them another 90 degrees in the process so that they are inverted with respect to their initial positions.

There are three hatches on the top of the collection vehicle housing, each hatch having more than one chute connected to it so that waste dumped into the hatch will fall into more than one bin, but only one type of waste to each bin. The inverted subcontainers are separated as they are being lifted to the top of the collection vehicle housing or, alternatively, once they are lifted thereto. The inverted subcontainers are then removed from the lifting system and moved, if necessary, so that each subcontainer is directly over and aligned with one hatch. Then the waste is allowed to fall through the hatches and into the chutes. In the chutes are shredders and crushers, depending on the waste type destined for each chute. The shredders and crushers shred and crush the waste as it falls so that, by the time it reaches the bins, its volume is less than what it originally was.

The collection vehicle proceeds to fill tile bins and then takes them to the distribution facility. The distribution facility comprises a pair of unloading decks, one on either side of the vehicle, where forklifts remove the bins through openings in the sides of the vehicle. Anti-friction slides mounted on tile floor of the vehicle make it easier to remove the bins. The bins are loaded onto flatbed or covered trailers, one type of waste to each trailer, covered with tarps and hauled away for recycling.

The collection vehicle is an important feature of the present invention. The collection vehicle automatically transfers the separated waste from the outside container to bins, preserving the integrity of the separation. It also reduces the volume of the waste as it is being transferred. The advantage of this feature is that all of the subcontainers, and indeed all the types of wastes in each compartment of these subcontainers, are transferred at one time without additional labor and without loss of the previously performed separation of waste types.

The cooperation between the inside and the outside containers is another feature of the present invention. The smaller inside container can be inverted over the larger outside container with its lid covering it and preventing waste from falling out prematurely. Then the lid can be slid out of the way after the two containers are aligned to let the waste transfer by gravity.

The distribution of the three subcontainers to multiple hatches is another feature of the present invention. Separating them simplifies the process of transferring the nine different types of waste to nine different, large bins. Moreover, separating them only after they reach the top of the vehicle is a related but equally important feature of the present invention, because it allows the three to be lifted and inverted together simultaneously by one apparatus.

The lifting mechanism is yet another important feature of the present invention. The lifting mechanism aligns, grips, and lifts, and if necessary, covers and inverts, the three subcontainers automatically. Alignment is needed if the ground on which the outside container cart location is uneven. The gripping is needed for securely lifting the subcontainers to the top of the mobile collection unit. The waste subcontainers are covered, either by the rotating mechanism at the top of the collection vehicle or the lifting mechanism itself, to prevent spilling. The waste containers are covered other means rather than by their own lid or lids because it is easier to uncover them when they are aligned with their respective hatches if the cover is part of the rotating mechanism or the lifting and distributing mechanism. Furthermore, the lift mechanism would require additional complications to avoid wear and tear on the lid because the lid could not be made durable enough at reasonable cost to handle repeated dumpings.

Volume reduction equipment in the chutes is another very important feature of the present invention. The waste can be collected more efficiently if its volume is reduced. By placing the processing equipment in the chute, there is no separate step involved, and no additional time needed, for volume reduction processing.

Another feature of the inside container is a device for storing a stack of flexible, plastic liners, of the type typically used to line garbage containers. The device presents the top one of the stack of liners for pulling out, whereupon the next liner is presented, in "tissue-box" fashion. This device is formed in the bottom of the compartment of the inside container designated for trash.

The cooperation between the collection vehicle and the distribution facility is still another feature of the present invention. The two decks of the facility are spaced apart just more than the width of the collection vehicle and are at the same height as the floor of the vehicle housing. Therefore, the vehicle can be parked between the decks and the bins rolled from it onto the deck by forklifts.

Other features and advantages of the present invention will be apparent to those skilled in the art from a careful reading of the Detailed Description of a Preferred Embodiment presented below and accompanied by the drawings.

BRIEF DESCRIPTION OF THE DRAWINGS

In the drawings,

FIG. 1*a* is a perspective view of an inside container according to a first embodiment of the present invention;

FIG. 1*b* is a detailed cross sectional view of the lid hinge of an inside container according to a first embodiment of the present invention;

FIG. 1*c* is a detailed cross sectional view of the liner retainer of an inside container according to a first embodiment of the present invention;

FIG. 6*a–c* are a series of side views of the lifting and rotating mechanism making the first rotation of an outside container and beginning the lift to the top of the mobile collection unit of FIG. 3;

DETAILED DESCRIPTION OF A PREFERRED EMBODIMENT

Figure 2:
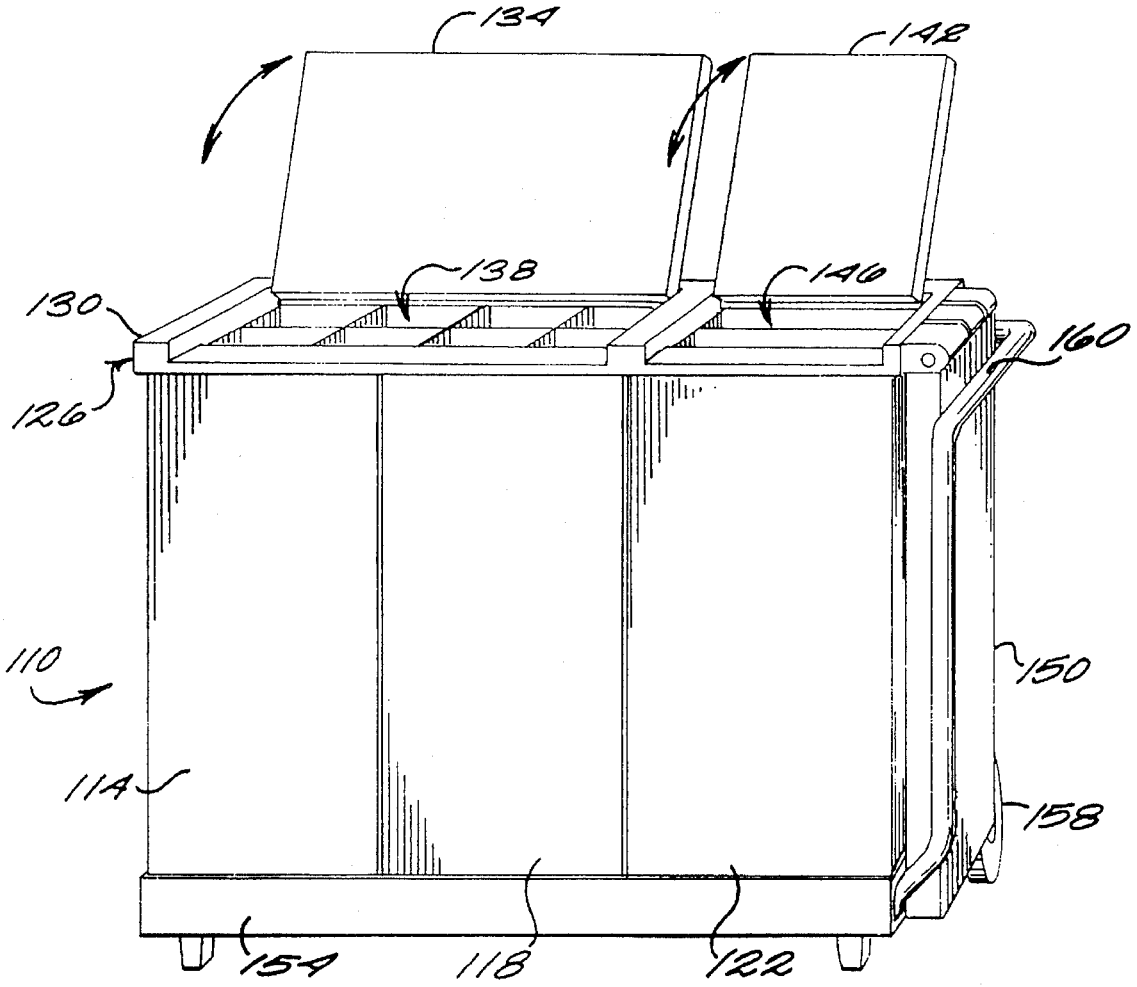
FIG. 2 is a perspective view of an outside container according to a first embodiment of the present invention.

In the following description similar components are referred to by the same reference numeral in order to simplify the understanding of the sequential aspect of the drawings.

The present invention is a method and system for collecting separated wastes. In its preferred embodiment, the system comprises four main components: an inside container, an outside container, a mobile collection unit, and a waste distribution station.

These main components will be described in turn and in detail. However, to better explain the relationship of each component to the other, the purpose and general structure of each will be briefly described first.

The inside container is used inside a home or office and has, in its preferred embodiment, nine compartments for nine different types of wastes: clear, green and amber glass; cardboard; paper; aluminum, other metal wastes, plastic, and other wastes such as organic materials. Each type of waste is placed in only one compartment. Wastes separated and collected in the inside container are transferred to the outside container in such a way that the separation of the wastes by type is preserved.

The outside container is larger than the inside container but also has nine compartments. The inside and the outside containers are configured in such a way that the inside container's contents can be dumped into the outside container and the separated contents will fall into the corresponding compartments of the outside container. The outside container also comprises a cart for moving the container from its normal location behind a house to the curb for pickup. Then, the wastes in the outside container are transferred to a mobile collection unit in such a way that the separation of wastes by type is again preserved and, further, the volume of the wastes of each type is reduced during the transfer.

The mobile collection unit comprises a trailer for hauling by a truck, or it can be configured as a self-propelled vehicle, with a frame, ten pull-out bins, a lifting and inverting apparatus, a distribution system for enabling the waste in the outside container to be deposited into the correct pull-out bin, and a waste volume reduction system including crushers and shredders that shred and crush the waste as it is dumped into the collection unit and falls into the bins. The mobile collection unit takes the wastes to the distribution station.

The distribution station is where the mobile collection unit unloads and distributes the bins to other vehicles, one type of waste to each vehicle, for transport to a location where the waste of that type can be reused or where any non-reusable waste can be disposed of.

Waste from a household or office falls generally into nine categories: three kinds of „lass (clear, amber, and green), aluminum, other metal, paper, cardboard, plastic, and garbage (mostly organics). Other types of waste may be defined from time to time for separation, or advanced processing of waste may make it unnecessary to separate some types, such as aluminum from other metals. However, the number of types described herein is somewhat arbitrary and does not limit the invention.

Some of these waste types can be processed to reduce its volume, so that it will occupy less volume after processing than before. Cans and glass bottles can be crushed; paper, cardboard and plastic can be shredded. Other volume reduction techniques exist, such as incineration and compaction. However, only mechanical processing techniques: shredding, crushing, compaction, are considered to be appropriate in the present invention without substantial modification to the present invention. Furthermore, compaction is not needed for most of the waste types and is therefore not included.

Reviewing now each major component in more detail, an inside container according to a preferred embodiment of the present invention is illustrated in FIGS. 1*a*–1*c* and is generally indicated by the reference numeral 10. Inside container 10 is not much larger than a typical, large waste container except that it is arranged into three portions: a first portion 14, a second portion 18 and a third portion 22. Each portion 14, 18, 22, has a lid. A lid 26 for first portion 14 is the same as a lid 26' for third portion 22; a lid 30 for second portion 18 is a typical lift-off type. First and third portions 14, 22, each have a divider 34 that forms four compartments 38. Second portion 18 has a single compartment 42 and is for use with garbage and preferably is lined with removable, flexible, plastic liners 46, pulled from a liner housing 50 located in the bottom of second portion 18 (see FIG. 1*c*). Housing 50 houses a stack 54 of liners 46 and has a slot 58 through which a next liner 62 is pulled. Next liner 62 is pulled from stack 54 through slot 58 and secured about the top of second portion 18. Preferably, liners 46 are standard, grocery-store-type plastic bags that are recyclable and used to package groceries.

Lids 26, 26' slid laterally from a closed position to an open position to uncover compartments 38 (see arrows in FIG. 1*a*). When slid far enough laterally, lids 26, 26' rotate downwards to the sides of first and second portions 14, 22, respectively. First and third portions 14, 22, each have a narrow channel 66 (the channels of third portion 22 are not shown) on each side for operation of lid 26 (see also FIG. 1*b*). A ball joint 70 connected to lid 26 rides in channel 66 until it reaches the end of channel 66 and lid 26 can rotate.

Inside container 10 is preferably marked to indicate the particular type of waste that is put into each compartment. Ideally, both color coding and symbols are used to alert the user to the correct type of waste, so that sorting is complete and correct. Once the sorting is done, however, the integrity of the sort is preserved through the outside container and mobile collection unit and distribution so that no further sorting of the waste is required; specifically, once the different types of waste are separated, they remain separated notwithstanding the transfer of several types simultaneously to the outside container, the mobile unit and the distribution facility. First, second and third portions 14, 18 and 22 also have finger recesses for ease in lifting and dumping into the outside containers.

An outside container, according to a preferred embodiment of the present invention, is illustrated in perspective in FIG. 2 and generally indicated by reference numeral 110. Outside container 110 is larger than inside container 10 and comprises three separable subcontainers 114, 118 and 122. A subcontainer is a container that is part of a group of other subcontainers and is handled with the others as a unit some of the time. Outside container 110 comprises two subcontainers 114, 118, each of which are divided into four compartments (as with first and third portions 14, 22 of inside container 10), and one larger subcontainer 122. Thus, outside container 110 has a compartment for each type of waste in correspondence to the compartments of inside container 10.

Outside container 110 has a three-part lid 126. A first part 130 rotates from a closed position to an open position in order to expose the compartments of all the subcontainers, 114, 118 and 122. A second part 134, carried by first part 130, rotates from a closed position to an open position to expose inner container-sized openings in lid 126 but over two outer subcontainers 114, 118, so that inner container portions 14, 22 can be inverted over outer container 110 at an opening 138 defined when second part 134 is rotated to the open position to transfer waste from first and third portions 14, 22, to subcontainers 114, 118, respectively. Outer container's three-part lid 126 remains closed during this process and only second part 134 is opened so that subcontainers 114, 118 can be made available to first and third portions 14, 22 for proper alignment.

A third part 142 of three part lid 126 uncovers subcontainer 122 for receiving the contents of second portion 18 of inner container 10. Third part 142 is dimensioned to receive second portion 18, but it is expected that plastic liners 46 will simply be carried by hand to outer container 110 and deposited into subcontainer 122 through an opening 146 formed by the rotation of third part 142 to its open position from its closed position.

Outside container 110 includes a cart 150 with a base 154, wheels 158 and a handle 160. Outside container 110 is wheeled to curbside for pickup by the mobile collection unit.

To transfer separated waste from inside container 10 to outside container 110, second part 134 of lid is rotated open and first and second portions 14, 22 are inverted over the corresponding compartments of subcontainers 114, 118, respectively, with lids 26, 26' in place. When first portion 14 is aligned with and engaging subcontainer 114, lid 26 is slid laterally and the separated wastes fall into the corresponding compartments of subcontainer 114. Then third portion 22 is inverted over, aligned with and engaging subcompartment 118, lid 26' slid laterally, and the waste of the compartment of third portion 22 will fall into the corresponding compartments of subcontainer I 18, its waste separation preserved. Inner container 10 may then be returned to the house for reuse while outer container 110 awaits routine pickup.

It will be seen from the embodiment of outside container 110 in FIG. 2 that for lids 26, 26' to be pulled laterally toward the user, first third portions 14, 22 have to be oriented in one specific way. This, plus optional color coding and marking, assures that the orientation of the inside and outside containers 10, 110 is consistent and thus the integrity of the separation of the wastes by types is preserved.

Figure 3:
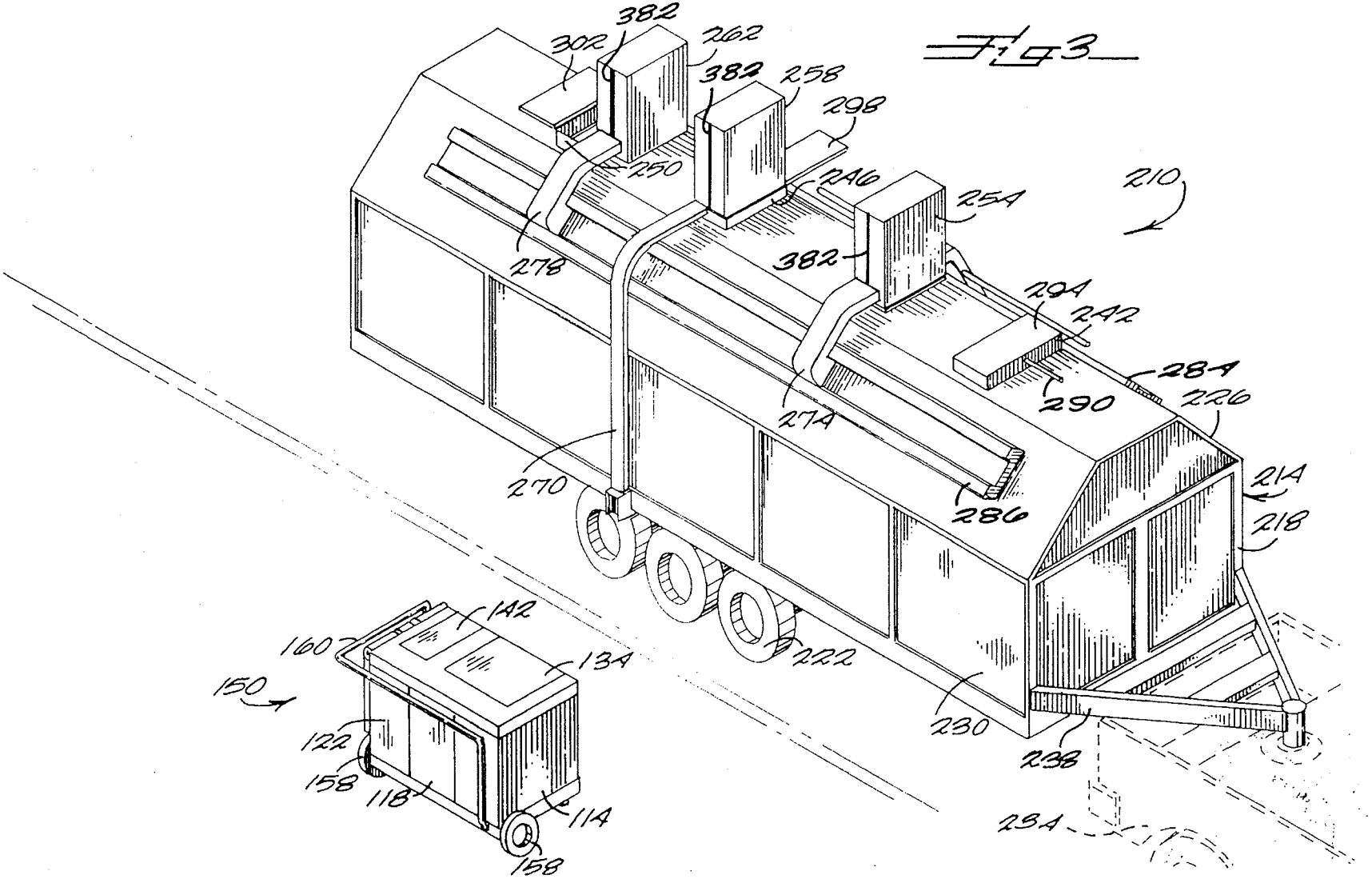
FIG. 3 is a perspective view of a mobile collection unit with an outside container curbside according to a first embodiment of the present invention.

FIGS. 3, 4*a* and 4*b*, 5*a* and 5*b*, 6*a*–6*c*, and 7*a*–7*c*, illustrate a mobile collection unit according to a first embodiment of the present invention. Mobile collection unit, indicated generally by reference numeral 210, is in the form of a towed van comprising a housing 214, including a frame 218, a plurality of wheels 222 attached to the underside of housing 214, a superstructure 226, and a plurality of bins 230 fitted into openings in the side of housing 214. Unit 210 can be hauled by a truck 234 using a hitch 238. Alternatively, unit 210 could be self-propelled. A towed van configuration, as shown in FIG. 3 is preferred, because truck 2,34 may have other uses and therefore some economy is realized by that configuration over self-propelled units.

Preferably, housing 214 has 10 bins 230, one bin for each of eight of the waste types and two for garbage, and five on each side of housing 214. Preferably the heaviest types of wastes are placed in the bins 230 that are directly over wheels 222 and the lightest wastes are designated for bins 230 near the ends of housing 214. Preferably, garbage is designated for the end of housing 214 opposite hitch 238.

On top of housing 214 are several hatches, preferably three hatches 242, 246, and 250. Subcontainers 254, 258, and 262 that comprise an outside container are lifted to the top of housing 214 via a side rail 270 and a lifting and inverting mechanism (to be described presently), then distributed over hatches 242, 246, 250, two subcontainers of which, 254, 262, are moved by clamps 274, 278 aligning lateral rails 284, 286. Subcontainer 254 is moved over hatch 242 by clamp 274; subcontainer 262 is moved by clamp 278 over hatch 250 by clamp 278. A hydraulic cylinder 290 (only one visible), removes each hatch cover 294, 298 and 302, respectively, so that the separated wastes in subcontainers 254, 258, and 262 can fall into housing 214 and to the appropriate bin 230.

Figure 9:
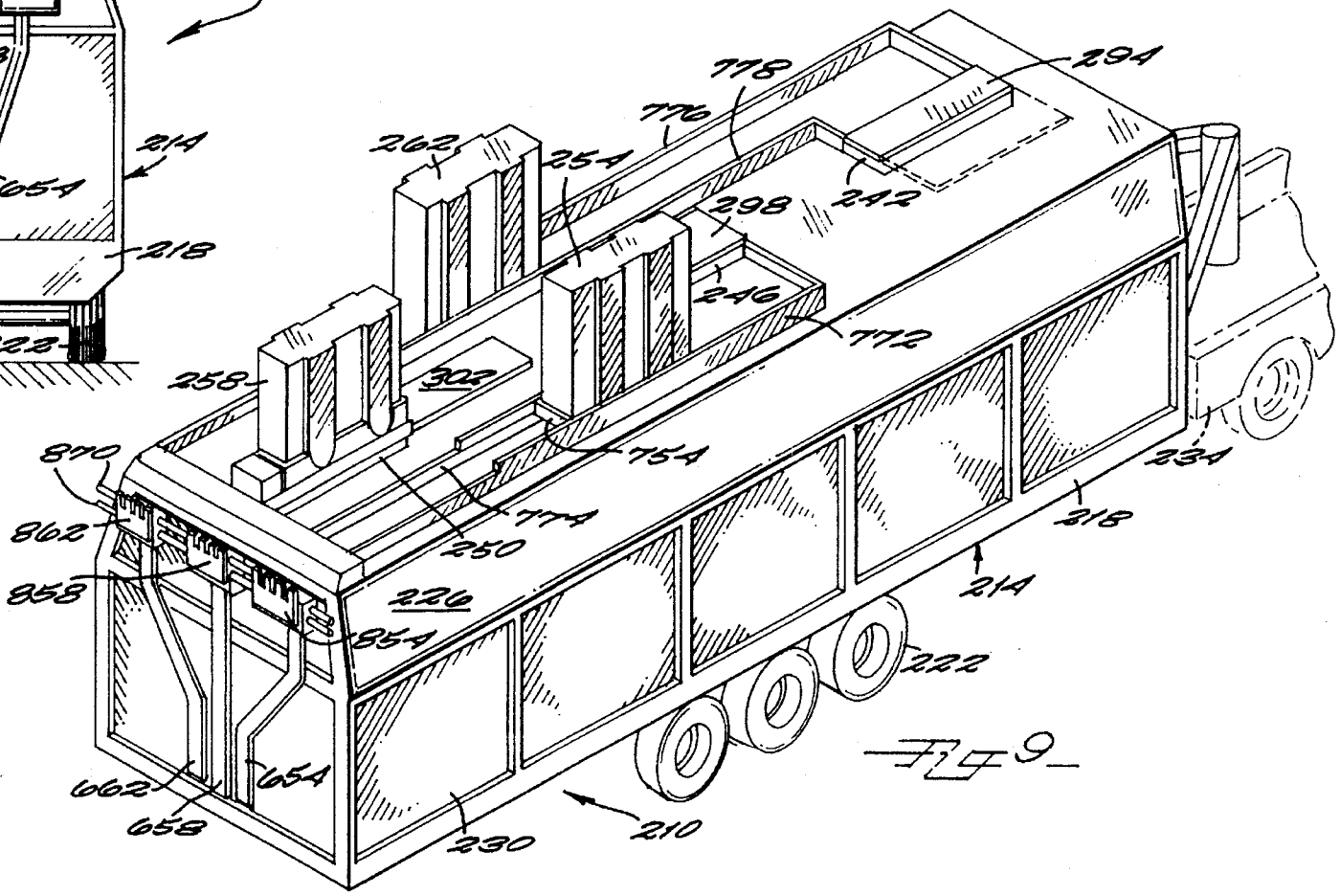
FIG. 9 is a perspective view of a mobile collection unit in operation according to the preferred embodiment of the present invention.
Figure 10:
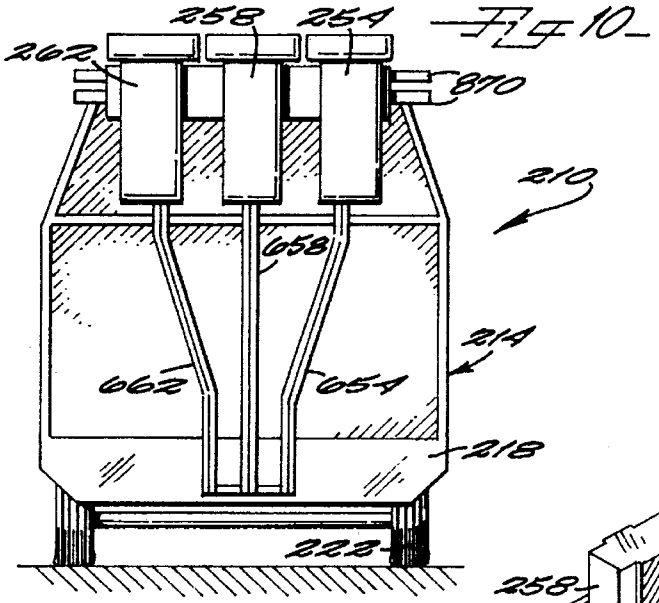
FIG. 10 is a rear view of the collection unit of FIG. 9 in operation according to the preferred embodiment of the present invention.
Figure 11:
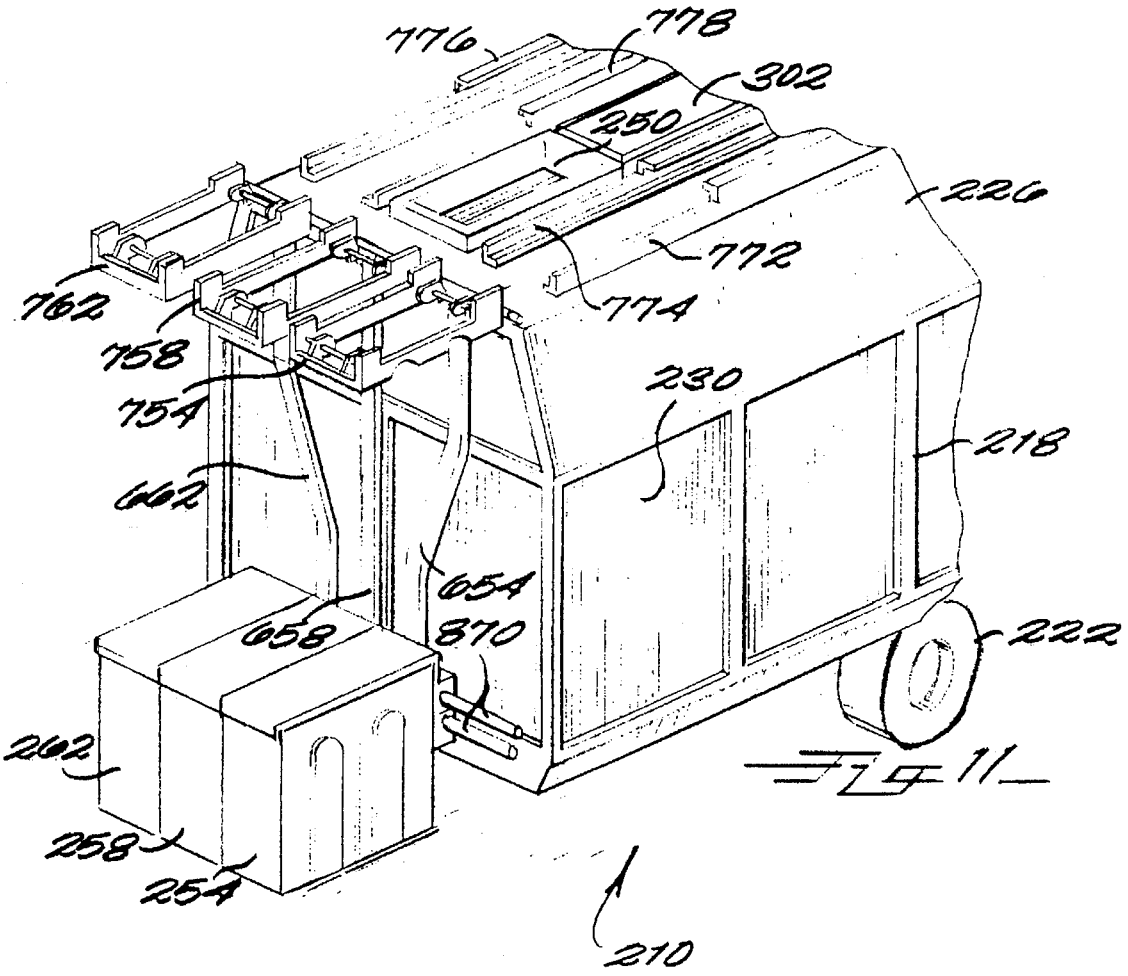
FIG. 11 is a partial perspective view of the back of a collection unit according to the preferred embodiment of the present invention.

Preferably, side rail 270 can be mounted on frame 214 at the rear of collection unit 210. Such an embodiment is shown in FIGS. 9–11 and discussed in detail below.

The lifting and inverting mechanism and the distribution mechanisms are most easily understood by first reviewing the process for handling the outside container. The outside containers, which as previously stated comprise three separate subcontainers, at the ready at curbside, are aligned and brought to a common elevation, gripped and covered as a unit. Then the three subcontainers are turned 90 degrees, again as a unit, lifted and, as they approach tile top of the superstructure, rotated another 90 degrees so that they are upside down with respect to their initial positions at curbside, as shown in FIGS. 3–7. Preferably, the three subcontainers can remain upright while being lifted to the top of the superstructure and then rotated 180 degrees to invert them, as shown in FIGS. 9–11.

Then, the two end subcontainers are moved laterally following the long axis of the mobile unit until they are in position over two of the hatches. The center subcontainer remains over a center hatch. The three hatch doors are opened simultaneously and the three subcompartments uncovered to allow the wastes to pass into the superstructure of the mobile unit, through the volume reduction equipment and into the bins below. Then, the three hatch doors are closed, and the three subcontainers are reassembled as a single container, rotated and lowered to the cart below.

The lifting and inverting mechanism, illustrated in a preferred embodiment in FIGS. 4*a*, 4*b*, 5*a*, 5*b*, and 6*a*–6*c*, includes several subcomponents. The first subcomponent of the lifting and inverting mechanism is the alignment mechanism illustrated in FIGS. 4*a* and 4*b*. The alignment mechanism comprises an alignment plate 306 that is rotated away from mobile unit 210 and upwardly by a hydraulic cylinder 310 and two members, an upper member 314 and a lower member 318, to position plate 306 under lips 322 of a set of subcontainers 326 to align and lift them to a common elevation. This action positions subcontainers 326 so that the lifting and inverting mechanism can cover and seal them with a two part plate 330 (shown in FIGS. 5*a* and 5*b*) and to grip them on both sides.

Figure 5A:
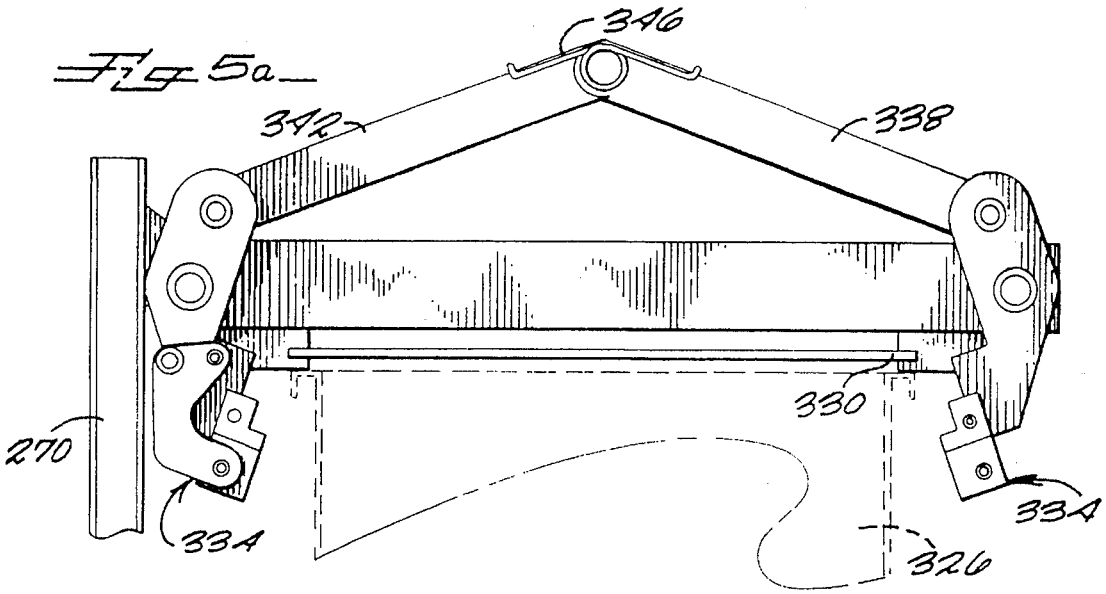
FIG. 5*a* is a side view of the locking mechanism of the lifting and rotating mechanism in the unlocked position as an outside container is moved into position.
Figure 5B:
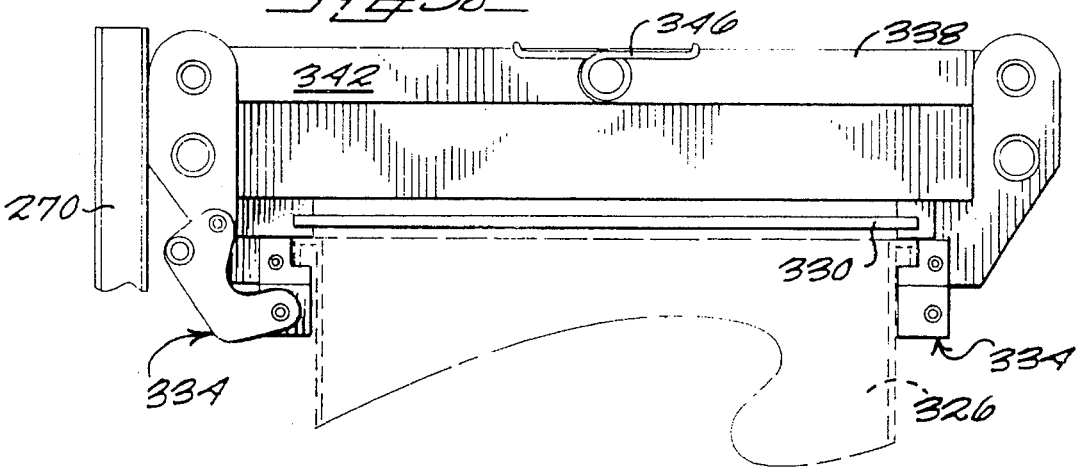
FIG. 5*b* is a side view of the locking mechanism of FIG. 5*a* in the locked position.
Figure 4A:
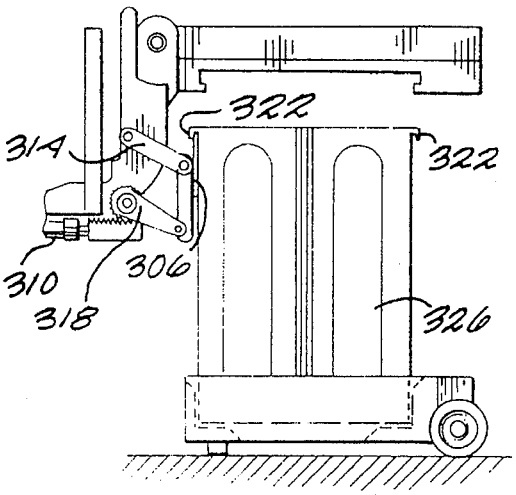
FIG. 4*a* is a side view of a portion of the lifting and rotating mechanism in the process of engaging and aligning the subcontainers of an outside container.
Figure 4B:
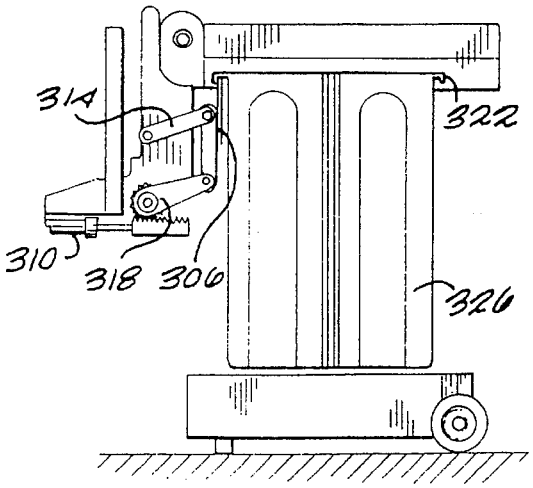
FIG. 4*b* is a side view of the portion of the lifting and rotating mechanism of FIG. 4*a* in the process of lifting and locking the subcontainers of an outside container.

Another subcomponent of the lifting and inverting mechanism is the gripping mechanism, illustrated in FIGS. 5*a* and 5*b*, which includes three sets of two locks each 334, one set of locks for each subcontainer 326 and one lock of each set 334 on each end of that subcontainer engaging the subcontainers lips 322. Locks 334 are moved into locking engagement with subcontainers 326 by two sets of linkages 338, 342 that are normally biased in an unlocked position by a pair of springs 346 but which move into the locked position in response to activation of the movement of hydraulic cylinder 3 10 that aligns three subcontainers 326. As hydraulic cylinder 310 pushes three subcontainers 326 into alignment, it urges locks 334 into engagement with lips 322. Locks 334 operate as a set; that is, when locks 334 on the mobile unit side of subcontainers 326 are urged into locking position, linkages 338, 342, cause both locks in lock set 334 to move into locking position simultaneously. Alignment plate 306 has cutout portions (not shown) for penetration by three pair of locks 334 on the mobile unit side so that they can engage lips 322 of subcontainers 326.

As illustrated in FIGS. 6*a*–6*c*, three subcontainers 326, each covered, sealed and locked into position by a two part plate 330, are then rotated 90 degrees so that their tops are toward the side of mobile unit 210. The three rotated subcontainers 326 will travel together up the side of mobile unit and be rotated once again, for another 90 degrees, so that they are then inverted with respect to their initial orientation.

The first 90 degree rotation is achieved by another hydraulic cylinder 350 attached to frame 218 of mobile unit 210 that, upon activation, causes a rack 354 to move inward with respect to frame 218 of mobile unit 210. A toothed gear 358 is rotated in its engagement with rack 354 and pulls on the first of two linkages 362, 366 that will rotate subcontainers 326 upward 90 degrees.

Once containers 326 are in the rotated position, the lifting and inverting mechanism begins to move up side rail 270 mounted to the side of mobile unit 210, pulled by a link chain carried by rail 270. When the lifting and inverting mechanism is barely out of its starting position on its way to superstructure 226 of mobile unit 210, a locking member 370 seizes a crescent-shaped lug 374 on the side of toothed gear 358 and holds it securely in position so that subcontainers 326 do not move from the rotated position.

As the lifting and inverting mechanism brings subcontainers 326 to superstructure 226, subcontainers 326 are rotated once again for the second 90 degree rotation by the curvature of side rail 270. The lifter reaches the topmost end of its travel when subcontainer 258 is directly over hatch 246 (see FIG. 3). At that point, the distribution mechanism takes over.

The distribution mechanism (best seen in FIG. 7*a*–*b*) has two sets of clamps 274, 278, each clamp gripping one side of subcontainers 254, 262, preferably by placing blades 378 into grooves 382 formed in the sides of subcontainers 254, 262. The planes of the opposing grooves 382 are perpendicular to the long dimension of mobile unit 210 and to the forces needed to move the subcontainers laterally, towards the ends of unit 210. Then the two sets of locks 334 of the lifting and inverting mechanisms separate from the center set of the three sets of locks 334 as tile two end subcontainers 254, 262 are moved laterally toward the ends of mobile unit 210. Subcontainers 254, 262 are guided by lateral rails 390, 394, and moved by hydraulic cylinders 398, 402, preferably rodless hydraulic cylinders, mounted for use in conjunction with lateral rails 390, 394.

When the two end subcontainers are separated from each other and the center subcontainer, two part plate 330 of the lifter is separated as well, one part traveling with subcontainer 254 and the other part with subcontainer 262. Subcontainer 258 is then uncovered but, because it is positioned directly over hatch 246, its contents will fall directly into that hatch.

Each hatch 242, 246, and 250 has its own cover 294, 298, and 302 operated by a hydraulic cylinder 290, 292. Hatches 242, 246 have covers 294, 298 that slide open towards opposite sides of mobile unit 210 and hatch 250 has a cover 302 that slides open to the front end of mobile unit 210. As subcontainers 254, 262 approach hatches 242, 250, the two parts of two part plate 330 are pushed aside and, when subcontainers 254, 262, are in place over hatches 242, 250, their hatch covers 294, 302 are removed by hydraulic cylinders 290, 292, respectively, allowing tile waste to fall.

FIGS. 9–11 show a more preferred embodiment in which the lifting, inverting, and distributing mechanisms are located at the rear of collection unit 210. In this preferred embodiment, a plurality of rear rails 654, 658, 662 separate subcontainers 254, 258, and 262 as they lift them to the top of superstructure 226. Then, a corresponding plurality of frames 754, 758, 762 lockingly engage subcontainers 254, 258, and 262 at the top of superstructure 226 and rotate them approximately 180 degrees so that subcontainers 254, 258, and 262 are inverted.

In the preferred embodiment shown in FIGS. 9–11, the relative orientation and location of hatches 242, 246, and 250 on the top of housing 214 have been preferably modified to better accommodate subcontainers 254, 258, and 262 being lifted from the rear, rather than the side, of housing 214. Alternatively, the alignment of subcontainers 254, 258 and 262 can be modified so that the each subcontainer will be directed to its proper hatch upon being lifted from the rear, rather than the side, of housing 214. Thus, subcontainer 258 is directly aligned with hatch 250 upon inversion of frame 758. Frame 754 then transports subcontainer 254 laterally via rails 772, 774 to hatch 246 for emptying. Similarly, frame 762 transports subcontainer 262 laterally via rails 776, 778 to hatch 242. Hatch covers 294, 298 and 302 operate as previously discussed. Hydraulic cylinders (not shown), preferably rodless cylinders, mounted to rails 772, 774, 776 and 778, are used to laterally move frames 754 and 762 between the respective rails.

Because of the positioning of rails 772, 774 and 776, 778 with respect to hatches 242, 246, and 250, subcontainers 254 and 262 must be moved laterally following the long axis of collection unit 210 until subcontainers 254 and 262 are adjacent to hatches 246, 242, respectively, then must be moved laterally in a second direction perpendicular to the long axis of collection unit 210 to be positioned directly over hatches 246, 242, respectively. Again, such movement is preferably performed by hydraulic cylinders (not shown), most preferably rodless cylinders, mounted for use in conjunction with rails 772, 774, 776, and 778.

The lifting, inverting, and distribution mechanisms for use in this preferred embodiment include ally number of well known components and techniques, including those described in the previous embodiment, to tile extent applicable. In this embodiment, as shown in FIGS. 9–11, subcontainers 254, 258, 262 are secured preferably by a set of grippers 854, 858, 862, respectively, that move vertically along rails 654, 658, 662 by hydraulic cylinders (not shown), preferably rodless cylinders.

The gradual digression of rails 654, 662 from rail 658 separates subcontainers 254 and 262 from subcontainer 258 as the subcontainers move vertically along tile mils toward the top of housing 214. A pair of horizontal or telescopic arms 870 stabilize tile lateral separation of grippers 854, 858, 862, as grippers move subcontainers 254, 258, and 262 vertically along rails 654, 658, 662, respectively.

When subcontainers 254, 258, 262 reach tile top of housing 214, their respective lids enter frames 754, 758, 762, respectively, and are locked into their respective frame using air cylinders (not shown). Then, air cylinders (not shown) are used to rotate frames 754, 758, and 762 approximately 180 degrees, thus inverting subcontainers 254, 258, and 262, respectively.

Once inverted, frame 754, still carrying subcontainer 254 therein, detaches from gripper 854 and is transported laterally between rails 772 and 774 by rodless cylinders mounted for use in conjunction with rails 772, 774. Similarly, frame 762 detaches from gripper 862 and, with subcontainer 262 still carried therein, moves laterally between rails 776 and 778 toward hatch 242 by rodless cylinders mounted for use in conjunction with rails 776, 778.

When frames 754 and 762 reach the ends of their respective rails, a pair of independent, secondary air cylinder systems (not shown) direct frames 754 and 762 directly over hatches 246 and 242, respectively. The contents of subcontainers 254, 258 and 262 are emptied into hatches 246, 250, and 242, respectively, as discussed in the previous embodiment and as discussed more fully below.

Figures 7A, 7B, 7C:
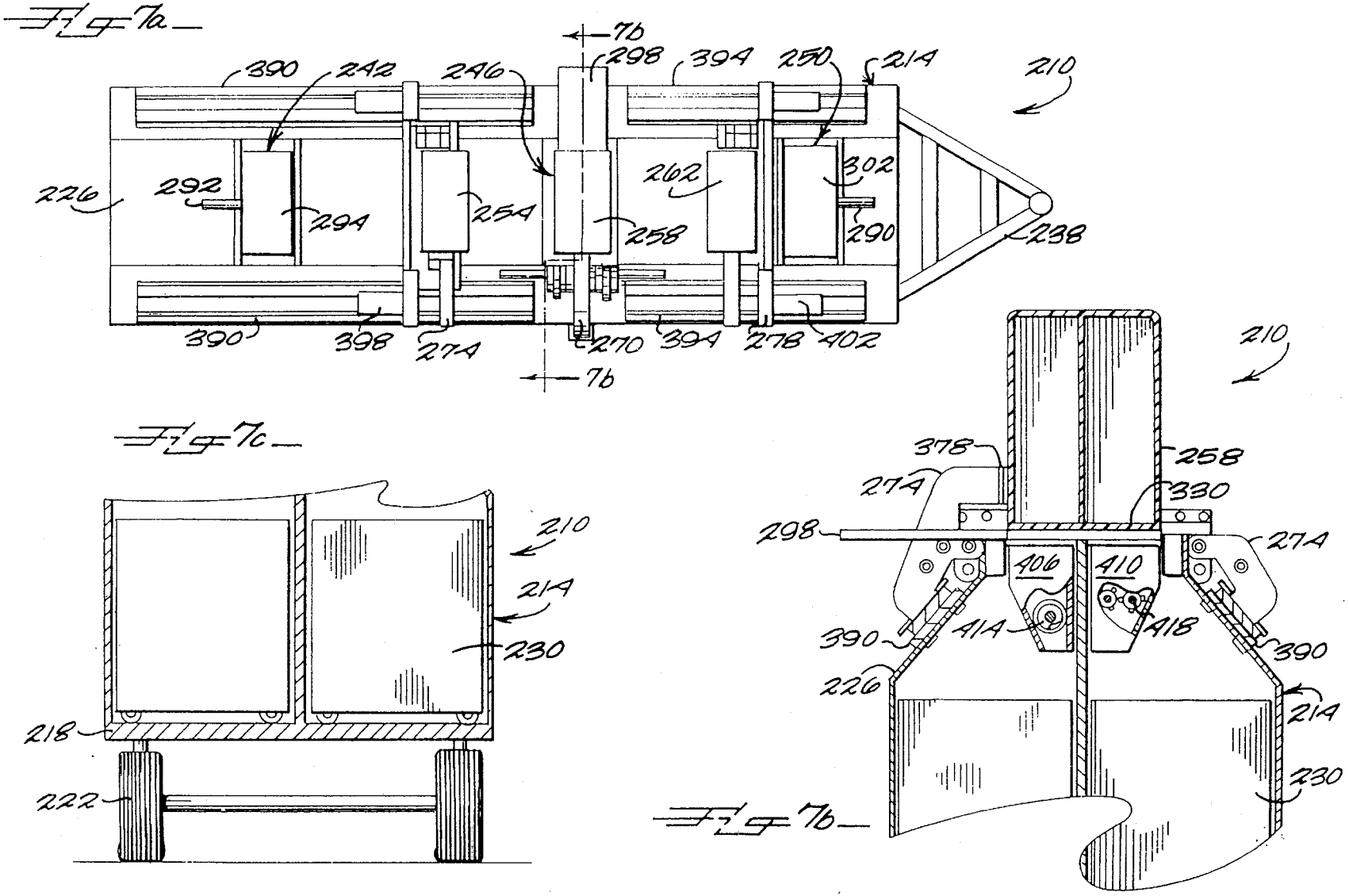
FIG. 7*a* is a top view of a mobile collection unit according to a first embodiment of the present invention.
FIG. 7*b* is a cross sectional view of the mobile collection unit taken along lines 7*b*—7*b* of FIG. 7*a* showing the upper portion of the unit.
FIG. 7*c* is a cross sectional view of the mobile collection unit taken along lines 7*b*–7*b* of FIG. 7*a* showing the lower portion of the unit.

Each hatch is connected to more than one chute 406, 410 (FIG. 7*b*). Hatches 242, 246 are directly over the intersection of four bins 230 and are therefore connected to those four bins by four chutes. Hatch 250 is connected to two bins and straddles those bins. The chutes guide the waste not only into the appropriate bin for the type of waste being dumped in that chute but also carry the volume reduction equipment. Volume reduction is done using a shredder 414 or a crusher 418 depending on the type of waste passing through the chute. Paper, cardboard, and plastics are shredded; aluminum and metal cans and glass are crushed. This volume reduction takes place as the waste is falling into the bins from the hatches.

In chute 406 is a shredder 414; in chute 410 is a crusher 418. Either a crusher or a shredder will be in each chute, depending on the type of waste to be passed through that chute. Glass, aluminum and other metals are crushed; plastics, paper and cardboard are shredded. The volume reduction of the waste assures that the final volume of the waste entering, each bin is less that the volume occupied by that waste as it enters the chute. Therefore, each bin 230 will be able to hold more waste than without volume reduction. Volume reduction is more important for bulky waste such as cans and bottles than for newspaper.

Figure 8:
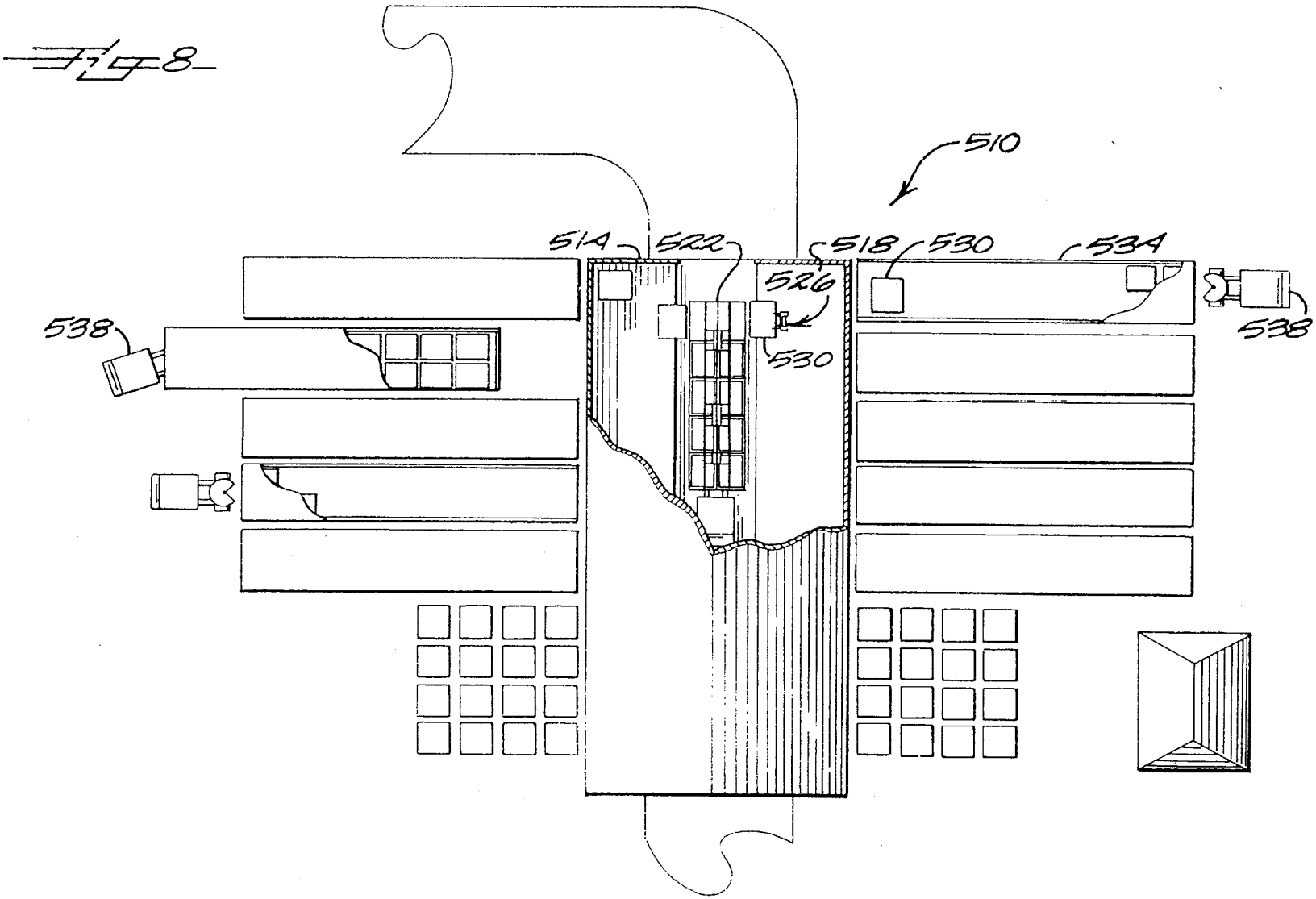
FIG. 8 is a top view of a distribution center according to a first embodiment of the present invention.

Each bin holds a different type of waste. When mobile collection unit 210 has made its rounds, it continues to a distribution facility 510, as shown in FIG. 8, comprising two parallel decks, 514 and 518, spaced apart slightly more than the width of the mobile unit 522 and elevated so that forklifts 526 on decks 514, 518, can easily remove bins 530 from the openings on both sides of mobile unit 522. Bins 530 are removed from unit 522 and placed on flatbed trailers 534 for hauling to a recycle facility or, in the case of garbage, to a sanitary landfill. A group of bins 530 of the same type of waste, such as, for example, clear glass, would be assembled on one of the trailers 534 for hauling by a tractor 538 to a recycle facility.

It will be apparent to those skilled in the art that many changes and substitutions can be made to the preferred embodiment herein described without departing from the spirit and scope of the present invention as defined by the appended claims.

What is claimed is:

1. Apparatus for collecting wastes sorted by type, said apparatus for use with a container having a plurality of compartments, each of said compartments holding only one type of said waste, said apparatus comprising:

a housing having an interior, an exterior, and at least one hatch for providing access to said interior of said housing;

a plurality of removable bins carried in said interior of said housing, each compartment of said plurality of compartments corresponding to only one bin of said plurality of bins;

means mounted to said exterior of said housing for moving said container over said hatch and aligning said container therewith so that said container can be emptied into said hatch;

means carried within said housing for distributing said wastes emptied through said hatch into said plurality of bins; and said housing having a plurality of openings for removing said plurality of removable bins from said interior of said housing.

2. The apparatus as recited in claim 1, wherein said exterior of said housing further comprises a frame defining a front and a back spaced apart from said front, and wherein said moving means is mounted on said back of said frame.

3. The apparatus as recited in claim 1, wherein said exterior of said housing further comprises a frame defining a front, a back spaced apart from said front, and a pair of sides between said front and said back, and wherein said moving means is mounted on one side of said pair of sides of said frame.

4. The apparatus as recited in claim 1, wherein said housing has a top, said container has an initial position, and said moving means further comprises:

means for lifting said container from said initial position to said top of said housing;

means for lockingly engaging said container once said container has been lifted to said top of said housing; and means for rotating said engaging means approximately 180 degrees so that said container is inverted from said initial position.

5. The apparatus as recited in claim 1, wherein said housing has a top, said container has an initial position, and said moving means further comprises:

means for rotating said container approximately 90 degrees from said initial position: and means for lifting said container to said top of said housing, said lifting means rotating said container approximately 90 degrees so that said container is inverted from said initial position.

6. The apparatus as recited in claim 1, further comprising means carried in said interior of said housing for reducing the volume said wastes.

7. The apparatus as recited in claim 1, wherein said distributing means further comprises a plurality of chutes carried in said interior of said housing so that said one type of said waste from said each compartment is received by said only one bin of said plurality of bins corresponding to said each compartment whereby said each bin of said plurality of bins holds said only one type of said waste.

8. Apparatus for collecting wastes sorted by type, said apparatus for use with a waste container comprising a plurality of subcontainers, said subcontainers being separable from one other, said apparatus comprising:

a housing having an interior, an exterior, and a plurality of hatches corresponding to said plurality of subcontainers for providing access to said interior of said housing;

a plurality of removable bins carried in said interior of said housing for receiving said waste from said waste container;

means mounted on said exterior of said housing for moving each of said plurality of subcontainers over said corresponding hatch so that each subcontainer can be emptied into said corresponding hatch: and said housing having a plurality of openings for removing said plurality of removable bins from said interior of said housing.

9. The apparatus as recited in claim 8, further comprising a plurality of chutes carried in said interior of said housing for distributing waste emptied into said hatches to said plurality of bins so that said one type of said waste from said each compartment is received by said only one bin of said plurality of bins corresponding to said each compartment whereby said each bin of said plurality of bins holds said only one type of said waste.

10. The apparatus as recited in claim 8, wherein said exterior of said housing further comprises a frame defining a front and a back spaced apart from said front, wherein said moving means is mounted on said back of said frame, wherein said container has an initial position, and wherein said moving means further comprises means for lifting said container from said initial position to said top of said housing;

means for lockingly engaging said container once said container has been lifted to said top of said housing; and means for rotating said engaging means approximately 180 degrees so that, when said container is lockingly engaged within said engaging means, said container is inverted from said initial position at said top of said housing.

11. The apparatus as recited in claim 8, wherein said exterior of said housing further comprises a frame defining a front, a back spaced apart from said front, and a pair of sides between said front and said back, wherein said moving means is mounted on one side of said pair of sides of said frame, wherein said container has an initial position, and wherein said moving means further comprises:

means for rotating said container approximately 90 degrees from said initial position; and means for lifting said container to said top of said housing, said lifting means rotating said container approximately 90 degrees so that said container is inverted from said initial position.

12. The apparatus as recited in claim 8, further comprising means carried in said interior of said housing for processing waste passing from said plurality of subcontainers to said plurality of bins so that the volume of said waste in said plurality of bins is less than the volume of said waste when said waste was in said plurality of subcontainers.

13. Apparatus for collecting wastes sorted by type, said apparatus for use with a waste container comprising a plurality of subcontainers, said subcontainers being separable from one other, said apparatus comprising:

a housing having an interior and a plurality of hatches corresponding to said plurality of subcontainers for providing access to said interior of said housing;

a plurality of bins carried in said interior of said housing for receiving said waste from said waste container;

means carried by said housing for moving each of said plurality of subcontainers over said corresponding hatch of said plurality of hatches so that each subcontainer can be emptied into said corresponding hatch;

means carried within said housing for distributing waste emptied into said plurality of hatches to said plurality of bins; and means carried in each of said plurality of hatches for reducing the volume of said wastes so that said wastes are reduced in volume as they are being received into said plurality of bins.

14. The apparatus as recited in claim 13, wherein said housing further comprises a floor and a plurality of openings in said housing, one of said plurality of openings for each bin of said plurality of bins, said plurality of bins being supported by said floor, said floor including means for sliding said each bin of said plurality of bins through said one opening of said plurality of openings.

15. The apparatus as recited in claim 13, wherein said housing has a top, said container has an initial position, and said moving means further comprises:

means for lifting said container from said initial position to said top of said housing;

means for lockingly engaging said container once said container has been lifted to said top of said housing; and means for rotating said engaging means approximately 180 degrees so that said container is inverted from said initial position.

16. The apparatus as recited in claim 13, wherein said housing further comprises a frame defining a front and a back spaced apart from said front, and wherein said moving means is mounted on said back of said frame.

17. The apparatus as recited in claim 13, wherein said housing further comprises a frame defining a front, a back spaced apart from said front, and a pair of sides between said front and said back, wherein said moving means is mounted on one side of said pair of sides of said frame, wherein said container has an initial position, and wherein said moving means further comprises:

means for rotating said container approximately 90 degrees from said initial position; and means for lifting said container to said top of said housing, said lifting means rotating said container approximately 90 degrees so that said container is inverted from said initial position.

* * * * *